United States Patent [19]

Stoll

[11] Patent Number: 4,699,042

[45] Date of Patent: Oct. 13, 1987

[54] FLUID POWER ACTUATOR

[76] Inventor: Kurt Stoll, Lenzhalde 72, D-7300 Esslingen, Fed. Rep. of Germany

[21] Appl. No.: 832,515

[22] Filed: Feb. 21, 1986

[30] Foreign Application Priority Data

Feb. 23, 1985 [DE] Fed. Rep. of Germany ..... 3506491

[51] Int. Cl.[4] ..... F15B 15/26

[52] U.S. Cl. ..... 91/44; 92/19; 92/23; 92/27; 74/527; 188/67

[58] Field of Search ..... 92/13.4, 13.7, 14, 19, 92/27, 28, 23; 91/43, 44, 45; 188/67; 74/527

[56] References Cited

U.S. PATENT DOCUMENTS

| | | | |
|---|---|---|---|
| 1,085,964 | 2/1914 | Briggs | 92/27 X |
| 1,302,738 | 5/1919 | Wallman | 91/44 X |
| 2,130,618 | 9/1938 | Gnavi | 91/45 X |
| 2,342,812 | 2/1944 | Martinson | 91/44 |
| 2,846,896 | 8/1958 | Allen | 74/527 X |
| 3,000,231 | 9/1961 | Cochran | 74/527 X |
| 3,000,359 | 9/1961 | May | 91/44 X |
| 3,096,554 | 7/1963 | Johnson | 188/67 |
| 3,958,813 | 5/1976 | Carey | 188/67 X |
| 4,519,329 | 5/1985 | Vacher | 91/44 X |

FOREIGN PATENT DOCUMENTS 697988 11/1979 U.S.S.R. ..... 92/27

OTHER PUBLICATIONS

"Lanced Metal Eliminates Separate Fasteners," in *Product Engineering*, 31, No. 36, 9-5-60, pp. 63 and 65.

*Primary Examiner*—Abraham Hershkovitz
*Assistant Examiner*—George Kapsalas
*Attorney, Agent, or Firm*—McGlew and Tuttle

[57] ABSTRACT

The invention relates to a fluid power actuator with a cylinder, a piston and a piston rod whose motion is controlled by a positioning device which halts it in selected settings. The positioning device has a row of depressions, for example gaps between the teeth of a rack, running parallel to the piston rod. A positioning plunger moves into a selected depression to lock the rod. A shutter with at least one opening therein covers the row of depressions and is adjustably affixed thereto so as to allow adjustment of the position at which the control plunger aligns with the shutter opening and slips into the selected uncovered depression to stop and lock the piston and rod.

23 Claims, 6 Drawing Figures

FLUID POWER ACTUATOR

BACKGROUND OF THE INVENTION

1. Field of the Invention

The invention relates to a fluid power actuator comprising a cylinder, a piston, a piston rod and a positioning means for halting the piston rod in desired positions.

2. Description of Prior Art

Such actuators are employed for applications in which a variable, preset terminal position of the piston and of the piston rod is necessary. Terminal abutments arranged in the caps of the actuator cylinder are able to be screwed into the interior of the cylinder varying amounts so as to limit the stroke of the piston to a certain extent. Such actuators are however relatively high in price since they are generally specially customized and in any case are of a complex design; in fact it is more or less essential to have a damper at the end of the stroke so that the terminal abutments will not be damaged by the piston striking them. A further shortcoming is that known actuators only make it possible for two abutment positions to be set with one position at a more or less retracted position of the piston rod and the other in a more or less extended one, and between these two end settings it is nearly impossible to preset exact intermediate positions of the piston or its rod at which such components may be precisely halted, at least for an instant. However in many applications it is essential to have an actuator whose piston rod may be moved in exact steps or sections of stroke, as for example when the actuator is to be used for a feed device in a machine tool, with which the workpieces are to have machining operations carried out on them, such as drilling or stamping, at positions with a precise setting between them.

SUMMARY OF THE INVENTION

One purpose of the present invention is to remedy such shortcomings of the prior art.

A further object of the invention is to devise a fluid power actuator of the above noted type, which while being able to be produced at a low price, makes it possible for the piston rod to be set in a position intermediate the two terminal positions thereof.

In order to achieve these or further objects appearing in the course of the following specification, the present invention is characterized in that the positioning device is embodied in a single integral unit with a series of consecutive detent depressions and is attached to the piston rod so as to extend in the longitudinal direction thereof, that the series of detent depressions is placed opposite a positioning plunger which may be engaged therewith and moved clear thereof, and there is a shutter between the row of detent depressions and the positioning plunger, and the shutter extends in the length direction of the series of notches and is connected therewith and has a positioning opening which is placed opposite to the detent depressions and is such that when the plunger arrives in a position during motion of the piston, it permits the plunger to extend into the detect depression, it being possible for one positioning opening to be associated with different detect depressions. There is thus the advantage that a conventional cylinder actuator may be fitted with a positioning device without modifications of the cylinder or the cylinder caps being required. It is an advantage if the positioning device acts on the part of the piston rod that is outside the cylinder.

This makes the construction substantially cheaper since it is even possible for conventional, pre-existing cylinder actuators to be fitted with the positioning device in accordance with the invention. A further advantage of the fluid power cylinder actuator of the invention is that it becomes readily possible to set the end positions of the piston rod in whatever the position desired without any difficulty at any desired point within the range of the stroke of the actuator and also to define intermediate settings between the end positions of the piston rod. The actuator of the invention is thus suitable for operations in which feed of the piston rod in steps or increments is imperative. Positioning takes place with a high degree of accuracy, since on reaching the desired point of the stroke the piston rod is instantaneously locked. The adjustment of the respective positioning settings is very simple, since the adjustment mechanism is higly accessible and easily inspected by eye and at the setting of the positioning opening or openings opposite the row of detect depressions it is possible to directly see the one of more positions at which the piston rod is locked. A further point is that the individual positioning settings are able to be set or reset at any time with perfect accuracy, something that would be scarcely possible with the actuators of the initially mentioned sort. A further beneficial effect of the actuator of the invention is the fact that a very short stroke may be set subsequently even in the case of very long actuators, this being almost impossible in the case of known actuator designs with integrated end stops; in such a case the end stops have to be screwed so far into the interior of the cylinder that they are no longer firmly held in place. A further aspect of the positioning device of the actuator in accordance with the invention is that positioning of the piston rod may take place from one end of the cylinder or it is even possible for both end settings to be altered from one end of the cylinder, something that is naturally more especially an advantage when fitting the cylinder to a pre-existing machine, for example, since the cylinder will have comparatively small space requirement. In the case of known actuators the adjustment of the two end settings of the piston rod is only possible if both ends of the cylinder are accessible.

In accordance with a preferred feature of the invention, the detect depressions are provided directly on the piston rod itself, this being a particularly compact way of providing the row of depressions since the dimensions of the piston rod do not have to be increased.

The row of detent depressions may be formed on a detent member detachably joined to the piston rod so that it is then possible to modify a conventional actuator in a simple way.

It is furthermore possible for the row of detent depressions to be in the form of a rack with its teeth placed transversely in relation to the direction of piston motion. This makes possible a particularly precise positioning of the piston rod. The row of detent depressions is comparatively simple to produce and furthermore the detent depressions may be placed very close together so that fine adjustment of the setting of the piston will be possible. A further useful effect of having the depressions in the form of a rack is that the teeth of the rack make possible a centering effect facilitating the insertion of the positioning plunger.

Alternatively the row of depressions may take the form of a row of holes, thus providing a particularly simple and cheap way of producing the invention.

If the length of the shutter is at least equal to the length of the row of detent depressions on may be certain that the positioning plunger is only able to fit into one of the detect depressions by way of the positioning openings. There is the advantage that the unused detent depressions are covered over so that trouble-free operation is guaranteed.

It is possible for the shutter having at least one positioning opening to be in the form of a shutter slide able to be adjusted in the longitudinal direction of the row of detent depressions. This makes it possible to change the individual positioning settings of the piston rod in a simple way. A further useful development in this connection is one in which the shutter coaxially surrounds the piston rod at least partially and runs in at least one guide groove extending parallel to the piston rod and made in the rod or in another member with the depressions therein. At least one positioning opening of the shutter may be able to be fixed in its settings placed opposite to the detent depressions so as to be prevented from sliding. Such features of design provide a simple and effective way of reliably and exactly guiding the shutter. The feature involving the fixing of the positioning opening ensures that there is no chance of the positioning opening, once set, being unintentionally moved in relation to the row of depressions. It is for example possible for the shutter to have positioning lugs of the like on the points of engagement with the piston rod or other member with the depressions therein. A further possible way of locking the shutter in place is by the provision of a catch tooth on its surface nearest the row of depressions so that such tooth may fit into the detent depressions. It is possible for the shutter to be directly in contact with the row of depressions and be held in place thereon or on the piston rod by spring means for example, or to keep the parts in position it is possible to have a pin connection.

It is possible for the shutter and/or the member with the detent depressions to be made of synthetic resin in order to reduce the costs of production.

The member with the detent depressions therein may be made of metal, this ensuring a particularly reliable positioning of the piston rod with a low wear rate.

It is possible to have means, such as spring or hydraulic means, urging the positioning plunger against the shutter during positioning of the piston rod and it may rest on the track along which the positioning opening moves. Such a design is characterized by an excellent response characteristic and it is an advantage that the positioning plunger quickly slips into the selected detent depression on arriving at the positioning opening. At the same time the design ensures that the positioning plunger does not slip out of the detent depression accidently.

In order to prevent damage to the device the advance motion of the piston rod may be controlled by means of a controller connected with the positioning plunger in accordance with the setting of the positioning plunger. The controller may be so designed that it interrupts the advancing motion of the piston rod simultaneously with the entry of the positioning plunger into the positioning opening or into one of the detent depressions. This form of controller is particularly compact which simultaneously with the entry of the positioning plunger into one positioning opening at the same time causes the advance motion of the piston rod by interrupting the supply of fluid power to the cylinder and thus ensures reliable operation with a low wear rate.

It is further possible for the positioning plunger to be adjustably set at a right angle to the plane of the detent depressions, this making it possible to undertake fine adjustment of the separate positioning settings of the piston rod. Owing to the adjustability of the positioning plunger the space between two consecutive detent depressions, which would not normally be used, may be bridged over. This feature of the invention accordingly makes possible a stepless positioning of the piston rod.

The invention will now be described on the basis of only a few of the possible embodiments thereof, to be seen in the accompanying drawings.

DESCRIPTION OF THE PREFERRED EMBODIMENTS

Figure 1:
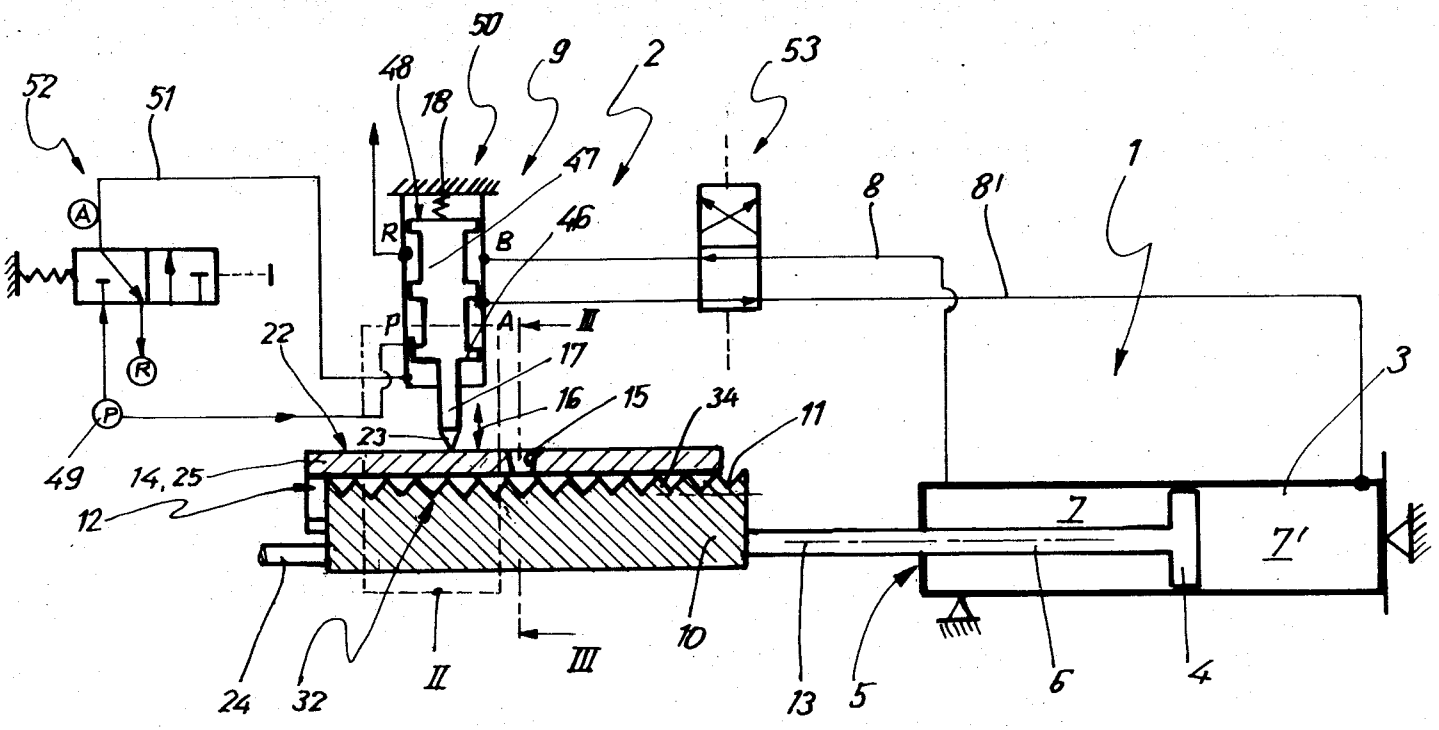
FIG. 1 shows a first embodiment of the fluid power actuator of the invention diagrammatically and in partial section.

In FIG. 1 the reader will see a fluid power actuator 1 in accordance with the invention with the positioning device 2. The actuator comprises a cylinder 3, a piston 4 sliding within the cylinder 3 and a piston rod connected with the piston 4 and extending out of the cylinder through its end wall 5. The piston 4 makes sealing contact with the inner bore face of the cylinder 3 and so divides the cylinder into two cylinder spaces 7 and 7' into and from which a fluid under pressure (more especially air) may be admitted and released as desired. Each of the cylinder spaces 7 and 7' is connected via a pressure fluid line 8 and 8' with a controller 9 which will be explained in more detail below, controlling the supply of pressurized fluid to the cylinder spaces 7 and 7'.

A member 10 having a row 12 of successive detent depressions 11 is joined, more particularly so that it may be detached, to the piston rod 6 as an axial extension thereof. The row of depressions runs parallel to the length direction 13 of the piston rod 6.

A shutter 14 or cover member is placed directly on and adjacent to the row 12 of depressions and it has a positioning opening 15 opposite one of the detent depressions.

A positioning plunger 17 is placed opposite the row 12 of depressions 11 and the shutter 14 so that it may be brought into engagement with one of the detent depressions 11 and may be moved towards and away from the said row 12 as marked by the arrow 16. The plunger 17 is resiliently urged towards the shutter 14, for example by a spring 18. Thus the shutter 14 is placed between the row 12 or depressions 11 and the positioning plunger 17. The plunger 17 is joined with the controller 9 for controlling or setting the advancing motion of the piston rod.

To give the reader a better general grasp of the system a short account of the function of the system is to be given at this point: in the starting position assumed the piston 4 and the piston rod 6 are completely retracted into the cylinder 3. The positioning opening 15 in the shutter 14 is placed opposite a given detent depression 11. The positioning plunger 17 is urged into contact with the facing surface 22 of the shutter by the spring 18 (or by hydraulic means). When now the controller 9 is suitably operated there will be a supply of fluid under pressure into the cylinder space 7' which does not have any piston rod so that the piston rod 6 and the member 10 with the detent depressions will be advanced linearly. In the course of such motion the free end 23 of the positioning plunger 17 will be moved onto the surface of the shutter. If the positioning opening 15 comes into a setting opposite the positioning plunger 17, the plunger 17 will be moved through the positioning opening 15 and make locking engagement with the corresponding detent depression 11. Simultaneously with start of the lowering motion of the positioning plunger 17 the controller 9 is actuated in such a way that the supply of fluid under pressure to the actuator is interrupted. The piston rod is thus not exactly positioned and located.

This cycle of functions may be used to exactly control the motion of a part of a machine that is not shown. This machine part is preferably connected by way of a suitable driving connected with the piston rod 6 or the member 10 with the depressions. As an example of this FIG. 1 shows a drive rod 24 extending from the member 10 with the depressions to form a coaxial extension thereof, for connection with a machine part such as a machine carriage.

Figure 3:
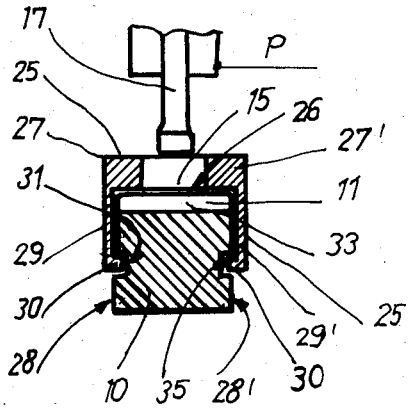
FIG. 3 is a cross section through the positioning device as taken on the line III—III of FIG. 1.

In what follows are more detailed account is now to be given of the member 10 with the depressions and the shutter 14. The shutter extends in the longitudinal direction of the row 12 of depressions and is connected with the member 10 having the depressions. In this respect the shutter 14 is in the form of an an adjustable cover slide 25 able to be moved in the longitudinal direction of the row 12 of depressions. The way of holding and guiding the cover slide 25 on the member 10 with the depressions will be seen more particularly from FIG. 3. In this case the member 10 has a square or other rectangular cross section and the cover slide 25 is placed directly on the surface 26 with the row of depressions 11. The breadth of the cover slide 25 as measured transversely in relation to the direction of advance is somewhat greater than that of the member 10 with the depressions so that on the two sides 27 and 27' of the cover slide 25 there is a lateral overlap past the member 10 with the depressions, and there is a molded-on guide rail 29 and 29' thereon at least partly covering the member 10 with the depressions in a lateral direction (at 28 and 28'). The cover slide 25 is in the form of a channel with the two legs of the channel section on the two sides of the member 10 with the depressions. At the free ends of the guide rails 29 and 29' there is molded a guide extension 30 running in the length direction of the member 10 with the depressions and pointing toward the two sides 28 and 28' thereof. This extension 30 is for its part slidingly mounted in in a complementary guide groove 31 in the member 10 with the depressions. A particular advantage of this form of the invention is that the shutter 14 or the covering slide 25 may be made of resin at this will ensure a particularly satisfactory sliding guiding effect with a low degree of wear. FIG. 3 furthermore shows the positioning plunger 17, a positioning opening 15 and a detent depression 11.

In order to assure a particularly effective cooperation between the positioning plunger 17 and the row 12 of depressions the row 12 is preferably formed as a rack 32 with the flanks 33 of its teeth extending transversely in relation to the direction of motion of the piston rod (see FIG. 3). In longitudinal section as in FIG. 1, the teeth have a zig-zag form such that the separate teeth have the forms of isosceles triangles. The positioning plunger 17 also has its free end 23 in the form of a wedge to fit inbetween the teeth. The rack 32 may be made integral with the member 10 having the depressions. Manufacture by milling is possible, although it may be made separately and then attached to the member 10 with the depressions, as for example by screws so that it may be detached again if required. In this form of the invention it is possible to use racks 32 with a finer or a coarser pitch as may be desired for a particular application. To facilitate the passage of the positioning plunger 17 through the positioning opening 15 the opening tapers conically towards the detent depressions 11. The sizes of the openings 15 are in any case to be such that it is possible for the positioning plunger to be readily moved through.

It will be clearly seen from the explanations so far that by adjustment of the cover slide 25 in relation to the member 10 with the depressions the position of the positioning opening along the row 12 of depressions may be changed so that variable setting of separate positioning settings for the piston rod 6 may be undertaken. To prevent unintentional shifting out of position of the cover slide 25 during operation, the slide may be locked in all its positions in which the positioning opening 15 is opposite one of the detent depressions 11 so that it may not be relatively slid. This may be made possible for example by having spaced recesses in the floor of at least one of the guide grooves 31 for cooperation with catches 35 made with a complementary form on the guide projections 30. These catches may for example be in the form of short pins. The distance between one recess or catch 35 and the next one will preferably be equal to the pitch of the rack 32.

Figure 4:
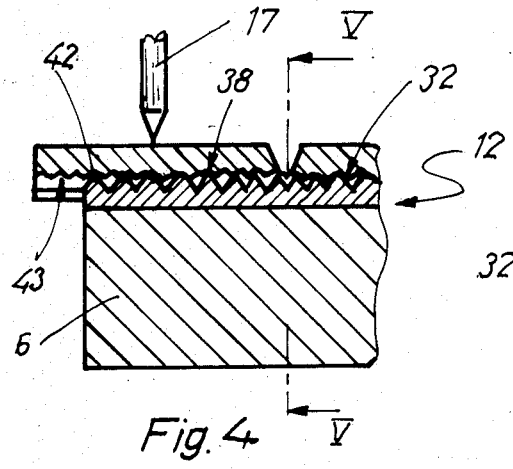
FIG. 4 shows a further possible embodiment of the invention as part of the actuator.
Figure 5:
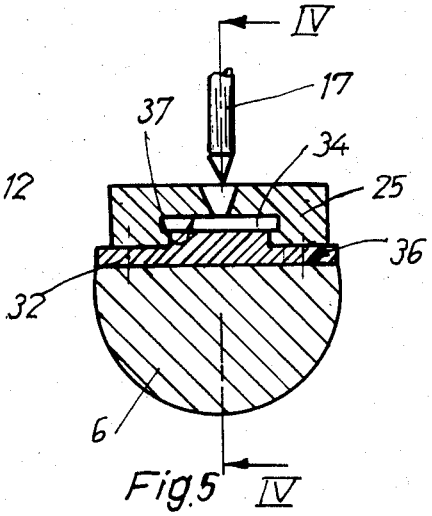
FIG. 5 is a section through the positioning device of FIG. 4 as taken on the section line V—V therein.

On the basis of FIGS. 4 and 5 a further example for the way of holding the covering slide 25 in relation to the row 12 of detent depressions will now be explained. In the case of this form of the invention the piston rod 6 itself functions as the member having the row 12 of depressions in the form of a rack 32. In this case the piston rod 6 is made flat along part of its length (at 36) and on this flattened part the rack 32 is attached for example by screws so that it may be removed. The breadth of the individual teeth 34 as measured in the transverse direction is less than the diameter of the piston rod 6 and at the same time in cross section the rack 32 is made so as to be generally T-like in cross section. The cover slide 25 has a matching T-like groove 36 so that while covering over the rack 32 and engaging the groove with the matching teeth, the cover slide is able to slide in relation to the piston rod 6 in the length direction. The covering slide 25 engages the free edges 38 of the rack 32 so as to make contact over a large area, such contact face 42 being provided with low braking teeth 43 corresponding to the rack 32 in pitch. These teeth prevent unintended slipping of the cover slide 25 and in this example of the invention the cover slide and the braking teeth 34 are fashioned of plastic material.

Figure 6:
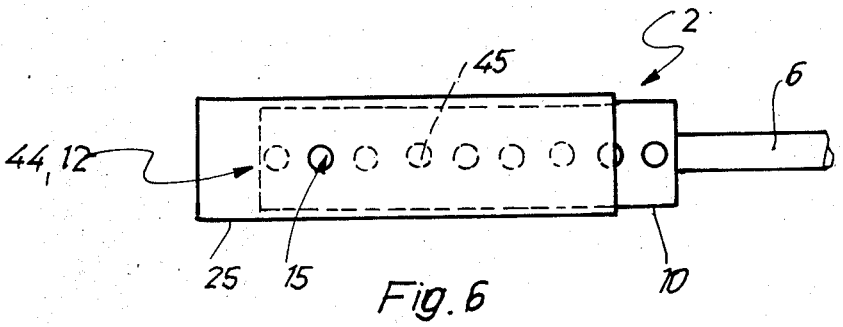
FIG. 6 is a view looking down onto a further working example of a positioning device after removal of the positioning plunger.

FIG. 6 is a plan view of a further working example of the positioning device 2 after removal of the positioning plunger 17. In this case the depressions in the row 12 are in the form of a row of holes 44, it being possible for the individual holes 45 to be through or blind holes. The positioning opening 15 has a corresponding shape.

As a general point, the cover slide 25 may be made with any desired number of positioning openings 15. The distance between the positioning openings 15 in each case defines the distance between two stop positions of the piston rod 6. By sliding the cover slide 25 in the relation to the member 10 with the depressions it is possible for these positions to be changed in a way dependent on the absolute position of the piston rod 6. The sliding guide means for the shutter 14 is however not necessary in all cases and it would also be possible to make the shutter 14 so that it would readily be able to be removed. In order to set different position settings in this case the shutter 14 may be replaced by another shutter which has positioning openings arranged in a different way (not shown). However both with the non-sliding and the sliding form of the shutter 14 its length will be such that it is equal to the length of the row 12 of detent depressions. This makes it possible to ensure that the positioning plunger 17 does not accidentally come into engagement with an uncovered detent depression. It is also to be added that the preferred combination of material for the shutter 14 and the member 10 with the depressions is a resin-metal one. Owing to the production of the shutter of resin its manufacture will be simple and cheap and will be molded in accordingly formed. The metal construction of the member 10 with the depressions assures positioning over a long period of time with a low wear rate. At the same time this combination of material facilitates the sliding of the two members in relation to each other.

Figure 2:
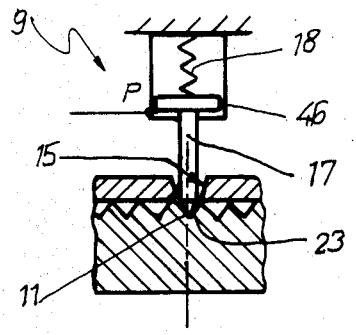
FIG. 2 shows a part of the structure of FIG. 1 as indicated II at FIG. 1 with the positioning plunger actuated.

In what now follows a more detailed account of the positioning plunger 17 and the controller 9 will be given. The positioning plunger 17 is so placed that during the full stroke of the piston rod it is urged onto the surface 22 for the shutter 14 and rests on the track moved along by the positioning opening 15. If during the course of motion of the piston rod the positioning opening gets as far as the positioning plunger 17 it will move through the positioning opening 5 and will move back into the detent depression 11 while being urged by a loading force. This position will be seen in FIG. 2 with a simplified view of the controller 9. The force urging the plunger 17 into the depression is supplied by the spring 18. In order to be able to remove the plunger 17 from the detent depression 11 it has a drive piston 46 placed on its end opposite to the free end 23 and the piston 46 may be acted upon by fluid under pressure in the opposite direction to the resilient form of the spring 18 so that the plunger 17 is moved out of the detent depression 11 and the positioning opening 15.

To prevent damage to the plunger 17, when it is slipped into the positioning opening 15, by the row 12 of depressions which is moving, the plunger is integrated with a controller controlling the supply of fluid under pressure into the actuator 3. In will be seen from FIG. 1 that the controller 9 has at its main component a 4/2 way valve 50 that has a port P for the feed line, two ports A and B for drive lines and a port R for the escape of air. The valve spool 47 controlling the connection of the separate ports with each other is connection with the valve plunger 17 and the two parts are able to reciprocate at a right angle to the surface of the covering structure. By adjustment of the positioning plunger 17 motion of the valve spool 47 takes place as well. On its end 48 opposite to the plunger 17 there is a spring 18 to load the valve spool and the plunger in a direction towards the shutter 14. The control operation takes place as follows; as long as the positioning plunger 17 is placed clear of a positioning opening 15 and contacts the covering 22 the fluid under pressure arriving from an accumulator 49 will be supplied via the ports P and A of the 4/2 way valve 50 and the fluid power pipe 8' joined therewith to the cylinder space 7 without any piston rod therein. The piston 4, the piston rod 6, the shutter and the member with the depressions will accordingly be moved forwards. When this takes place the cylinder space 7 with the piston rod will be vented via the line 8 and the ports B and R. Once the positioning opening 15 reaches a position opposite to the positioning plunger 17 the latter will move into the positioning opening 15 so that as a result the feed port P is closed by the valve spool 47. To make possible further motion of the piston rod 6 a part of the valve spool 47 is in the form of a drive piston 46 which may be acted upon via a control line 51 against the force of the spring 18. This control line leads to a control valve 52 and after its operation may be connected with the pressure accumulator 49. In order to release the detent connection it is therefore only necessary to operate the control valve 52 for a short time so that the valve spool 47 is moved out against the action of the spring 18 and is accordingly moved by the positioning plunger 17 clear of the positioning opening 15. After such removal the fluid is supplied in the way already described through the 4/2 way valve 50. To make it possible for the piston rod motion to be reversed, it is possible to fit a reversing valve 53, having some suitable means for operating it, between the two lines 8 and 8' running from the two drive ports A and B. It is possible, if desired, for the fluid to be supplied to one or other of the two cylinder spaces 7 and 7'.

In the arrangement of FIG. 1 the minimum distance between to positioning settings of the piston rod 6 is determined by the pitch, i.e. the distance between one detent depression 11 and the next. If even finer positioning is to be possible, then in accordance with a further form of the invention (not shown) the positioning plunger 17 or the 4/2 way valve of the controller 9 is able to be adjusted parallel to the length direction and to the plane of the row 12 of detent depressions. With this form of the invention the piston rod may be set steplessly.

The actuator of the invention and its positioning device are naturally not limited to the use of the controller 9 as described and any other suitable controller would be possible. In particular the control valve 52 may be worked by a machine element and the overall cycle of motion may be automatically controlled.

I claim:

1. A fluid power actuator comprising a cylinder, a piston therein, a piston rod and a positioning device for arresting said piston rod in desired, selectable positions and being made up of:

a member exhibiting a row of consecutive detent depressions, said row being parallel to the said piston rod, said member being joined to said piston rod, a positioning plunger placed opposite to said detent depresions, means for moving said plunger into and out of engagement with said depressions, a shutter between the row of detent depressions and the said positioning plunger, said shutter extending in a length direction of said row and being joined to said member, said shutter having at least one through positioning opening therein opposite to said detent depressions and being such that on motion into a position opposite the positioning plunger during motion of the piston it makes possible entry of the plunger into one of said depressions, said at least one positioning opening being able to be associated with different depressions in said row.

2. The actuator as claimed in claim 1 wherein said member with said row of depressions therein forms part of the said piston rod.

3. The actuator as claimed in claim 1 wherein said member with said row of depressions is joined to said piston rod.

4. The actuator as claimed in claim 3 wherein said member with said row of depressions may be detached from said piston rod.

5. The actuator as claimed in claim 3 wherein the member with the row of depressions therein is fashioned of resin material.

6. The actuator as claimed in claim 3 wherein the member with the row of depressions therein is fashioned of a metallic material.

7. The actuator as claimed in claim 1 wherein said row of detent depressions is in the form of a planar rack with teeth directly transversely in relation to said piston rod.

8. The actuator as claimed in claim 1 wherein said row of depressions is in the form of a row of holes.

9. The actuator as claimed in claim 1 wherein the length of the shutter is equal to at least the length of the row of detent depressions.

10. The actuator as claimed in claim 1 wherein said shutter having at least one positioning opening is in the form of a cover slide adjustably sliding in the length direction of the row of detent depressions.

11. The actuator as claimed in claim 10 wherein the said cover slide at least partly surrounds coaxially the piston rod and the row of depressions and runs in at least one guide groove running parallel to the length direction of the piston rod, said groove being in the piston rod.

12. The actuator as claimed in claim 11 comprising means for arresting the cover slide so that the at least one positioning opening in the cover slide is opposite a selected one of the depressions.

13. The actuator as claimed in claim 12 wherein the cover slide is formed with a catch on a surface thereof opposite the said row, said catch being adapted to fit into said depressions for locating the cover slide in position.

14. The actuator as claimed in claim 10 wherein the said cover slide at least partly surrounds coaxially the piston rod and the row of depressions and runs in at least one guide groove running parallel to the length direction of the piston rod, said groove being in the member with the row of depressions.

15. The actuator as claimed in claim 1 wherein said shutter is directly adjacent with the row of depressions.

16. The actuator as claimed in claim 1 wherein said shutter is made of resin material.

17. The actuator as claimed in claim 1 comprising means for urging said positioning plunger against said shutter along the path moved through by the positioning opening.

18. The actuator as claimed in claim 1 comprising a controlling means connected with said positioning plunger to cause advancing motion of said piston in a way dependent on the position of said positioning plunger.

19. The actuator as claimed in claim 18 wherein said controlling means is adapted to interrupt advancing motion of the piston rod simultaneously with entry of said positioning plunger into the positioning opening and one of said depressions.

20. The actuator as claimed in claim 19 wherein said controlling means comprises a four-way valve with a valve spool parallel to the plunger and joined to one end thereof.

21. The actuator as claimed in claim 1 wherein said positioning plunger is adjustably placed at a right angle to the row of detent depressions.

22. The actuator as claimed in claim 1 wherein said positioning plunger may be adjusted parallel to said row of depressions.

23. A device for determining intermediate positions of movement of a piston which is movable in a cylinder between two end positions and has a piston rod movable relatively to the cylinder with the piston, comprising a member having a row of detent depressions and connected to the piston rod so as to move said detent row substantially parallel to the piston rod upon movement of said piston, a positioning plunger disposed opposite said row of detent depressions, means for moving said plunger into and out of engagement with a selected depression, a shutter adjacent said row of depressions and being positionable independently of said member between said member and said plunger and having at least one true positioning opening alignable with a selected detent depression permitting passage of said plunger into the aligned detent depression.

* * * * *